US005154454A

United States Patent [19]

Hollaway

[11] Patent Number: 5,154,454

[45] Date of Patent: Oct. 13, 1992

[54] CONCEALED EXIT DEVICE WITH ADJUSTMENT MECHANISM

[75] Inventor: William G. Hollaway, Lebanon Junction, Ky.

[73] Assignee: Monarch Hardwire & Mfg. Co., Inc., Shepherdsville, Ky.

[21] Appl. No.: 830,582

[22] Filed: Feb. 6, 1992

[51] Int. Cl.[5] ..... E05C 1/12

[52] U.S. Cl. ..... 292/21; 292/DIG. 60; 292/92

[58] Field of Search ..... 292/21, 92, DIG. 60

[56] References Cited

U.S. PATENT DOCUMENTS

| | | | |
|---|---|---|---|
| 1,033,151 | 7/1912 | Butler | 292/21 |
| 1,721,489 | 7/1929 | Prinzler | 292/92 |
| 2,887,336 | 5/1959 | Meyer | 292/21 |
| 3,583,740 | 6/1971 | Armstrong | 292/21 |
| 3,660,940 | 5/1972 | Tavano | 292/92 |
| 4,368,905 | 1/1983 | Hirschbein | 292/DIG. 60 |
| 4,601,499 | 7/1986 | Kim | 292/DIG. 60 |
| 4,881,765 | 11/1989 | Heid | 292/DIG. 60 |
| 5,042,851 | 8/1991 | Hunt | 292/DIG. 60 |

*Primary Examiner*—Eric K. Nicholson
*Attorney, Agent, or Firm*—Cushman, Darby & Cushman

[57] ABSTRACT

A concealed exit device for mounting vertically within a door to cooperate with a threshold latch plate and an overhead latch plate in a door opening for latching and unlatching the door within the door opening. The concealed exit device includes a manually actuated member for mounting in a central portion of the door for manual movement from one side of the door between a normally biased position and an actuated position, upper and lower latching mechanisms for mounting in upper and lower ends of the door for movement between extended latched positions in cooperating latched relation with the overhead and threshold latch plates respectively and retracted unlatched positions out of cooperating relation with the latch plates. The device further includes a motion-transmitting mechanism between the centrally located manual actuating member and the end located upper and lower latching mechanisms for effecting movement of the latching mechanisms from the extended latched positions thereof into the retracted unlatched positions thereof in response to the manual movement of the manual actuating member. The motion-transmitting mechanism includes an upper elongated motion-transmitting member a lower elongated motion-transmitting member, and an adjusting mechanism for adjusting the operative vertical extent of the upper and lower motion-transmitting members to accommodate the vertical extent of the door. The adjusting mechanism can be accessed through cover member while the device is in operating condition.

22 Claims, 6 Drawing Sheets

18
152
14
10
26
22
32
30
129
23
24
24
34
36
70
38
33
156
37
12
160
35
39
72
127
28
124
32
26
16
146
20

CONCEALED EXIT DEVICE WITH ADJUSTMENT MECHANISM

This invention relates to a concealed vertical exit device, and in particular to an improved operating mechanism for adjusting the door latching mechanisms of the device to accommodate the particular height of the door within which the device is mounted.

Conventional concealed vertical exit devices are mounted in doors which accommodate the passage of people through the door opening. Such devices are traditionally plagued with installation and adjustment problems experienced by installers and maintenance people who perform the actual installation of the device in the door, and the door within the door opening. Typical exit devices include rod connectors which are operatively associated with cam/deadbolt latching mechanisms operable to enter and to be disengaged from a threshold catch-plate and an overhead latch plate. The rod connectors are cooperable with a manually actuated bar mechanism disposed on the outer surface of the door. When installing or maintaining such devices, it is often necessary to adjust the length of the rod connectors to facilitate proper installation within the door and proper latching of the latching mechanisms with the plates. Conventional exit devices require considerable disassembly of the device to effect such adjustments, such as removing the bar mechanism, which substantially increases the time required to effect the adjustment. In addition, if the bar mechanism is required to be removed from the door to facilitated the adjustment of the rod connectors, it is difficult to assure proper fit of the cam/deadbolt latching mechanisms with the plates and to assure that the proper positional relation is maintained between all cooperable parts of the device, so that the device functions properly. It is therefore preferable to have the bar mechanism in operating relation with the rod connectors when the adjustment of the rod connectors is being made. Exit devices such as exemplified in U.S. Pat. No. 4,601,499, require the installer to secure the rod connector with a locking device, such as a set screw or the like after the adjustment is made. These locking devices frequently fail due to slippage or damage as a result of over-tightening. Furthermore, such devices use a bracket connection to connect to the adjustment mechanism, thus creating a weak area, susceptible to flexing and failure.

Conventional exit devices which provide a mechanism for adjusting the length of the rod connectors are limited as to the amount of adjustment available, due to the physical constraints of their design. In addition, rod lengths and door preparation vary with these devices which increases the time required to prepare a door and install such a device therein.

A need therefore exists to provide a exit device in which the adjustment of the rod connectors can be accomplished with simplicity from an outer surface of the door without considerable disassembly of the bar mechanism mounted externally on the door. A need exits to assure that the proper fit of the cam/deadbolt latching mechanisms can be obtained while all operating mechanisms of the device are in cooperating relation, which reduces the time to install or service the device.

An object of the present invention is to fulfill the need referred to above. In accordance with the principles of the present invention, this objective is obtained by providing a concealed exit device for mounting vertically within a door to cooperate with a threshold latch plate and an overhead latch plate in a door opening for latching and unlatching the door within the door opening. The concealed exit device includes a manually actuated member for mounting in a central portion of the door for manual movement from one side of the door between a normally biased position and an actuated position, upper and lower latching mechanisms for mounting in upper and lower ends of the door for movement between extended latched positions in cooperating latched relation with the overhead and threshold latch plates respectively and retracted unlatched positions out of cooperating relation with the latch plates. The device further includes a motion-transmitting mechanism between the centrally located manual actuating member and the end located upper and lower latching mechanisms for effecting movement of the latching mechanisms from the extended latched positions thereof into the retracted unlatched positions thereof in response to the manual movement of the manual actuating member from the normally biased position thereof into the actuated position thereof. The motion-transmitting mechanism includes an upper elongated motion-transmitting member extending vertically between the upper latching mechanism and the manually actuated member and a lower elongated motion-transmitting member extending vertically between the lower latching mechanism and the centrally located manually actuated member, and an adjusting mechanism for adjusting the operative vertical extent of the upper and lower motion-transmitting members to accommodate the vertical extent of the door. The adjusting mechanism has movable members operatively connected with the upper and lower elongated motion-transmitting members for effecting the adjustment of the operative vertical extent of the upper and lower motion-transmitting members to accommodate any particular vertical extent of the door within a relatively wide range while the manually actuated member, the upper and lower latching mechanisms and the motion transmitting mechanism are in an operative relationship. The movable member includes elements cooperable to receive a generally horizontal input engaging manual motion being operable when the input manual motion is received to move (1) from a set to an unset position in response to a setting and unsetting manual movement, and (2) to effect an adjustment of a motion transmitting member in response to an adjusting manual movement. The exit device further includes an exterior cover assembly being independent of the operation of the manually actuated member, the motion-transmitting mechanism and the upper and lower latching mechanisms operable to be moved from a normal covering position into a position providing exterior generally horizontal access to the movable member.

Another object of the present invention is the provision of device of the type described, which is simple in construction, effective in operation and economical to manufacture and maintain.

These and other objects of the present invention will become apparent during the course of the following detailed description and appended claims.

The invention may be best understood with reference to the accompanying drawings wherein an illustrative embodiment is shown.

Figure 1:
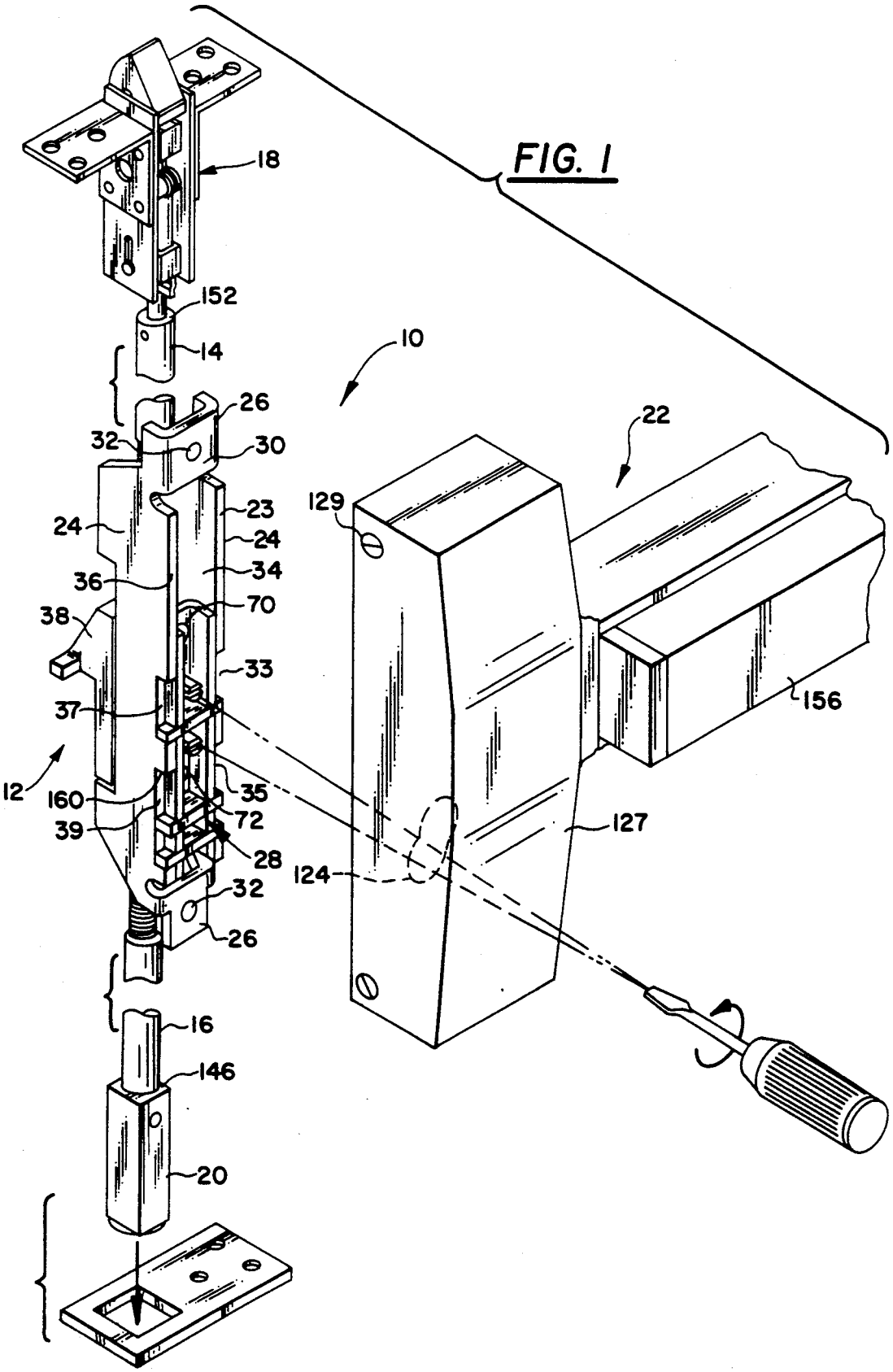
FIG. 1 is a perspective view of a concealed exit device for mounting vertically within a door embodying the principles of the present invention, shown with the actuating bar mechanism in a disconnected position.
Figure 4:
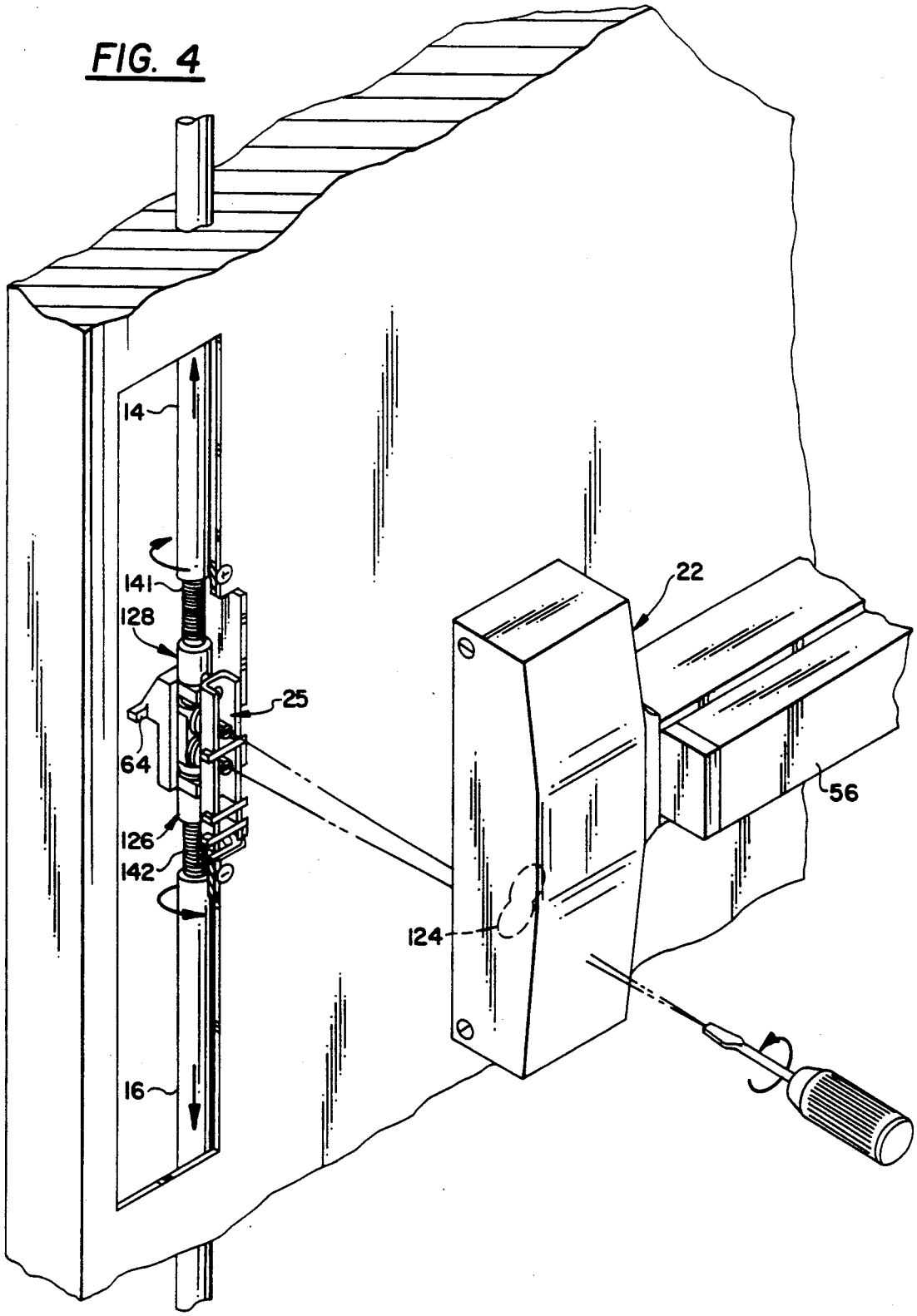
FIG. 4 is a schematic view of the motion transmitting member mounted to the inside of a door shown with the actuating bar mechanism of the exit device removed from the door for clarity.

Referring now to the drawings, there is shown therein a concealed vertical exit device, generally indicated at 10, which embodies the principles of the present invention. Referring more particularly to FIGS. 1 and 4, it can be seen that the device 10 consists essentially of an motion transmitting member, generally indicated at 12 having connecting rods, 14 and 16; a cam latching mechanism, generally indicated at 18; a dead bolt latching mechanism 20; an actuating bar mechanism, generally indicated at 22 and a housing structure 23.

The housing structure 23 of the exit device 10, is shown in FIG. 1, in accordance with the principles of the present invention. The housing structure includes side surfaces 24, end portions 26 and a central portion 28. The end portions 26 define an upper planar surface 30. The end portions 26 are provided with bores 32 therethrough, for mounting the housing structure 23 to the inside surface of a door as shown in FIG. 4. The central portion 28 includes a channel-like opening 34 therethrough. Surface 36 of sides 24 extends beyond the planar surface 30 and beyond the outer surface of the door, when the device 10 is mounted. Channels 33 and 35 are provided in sides 24, defining ledges 37, 39.

Figure 2:
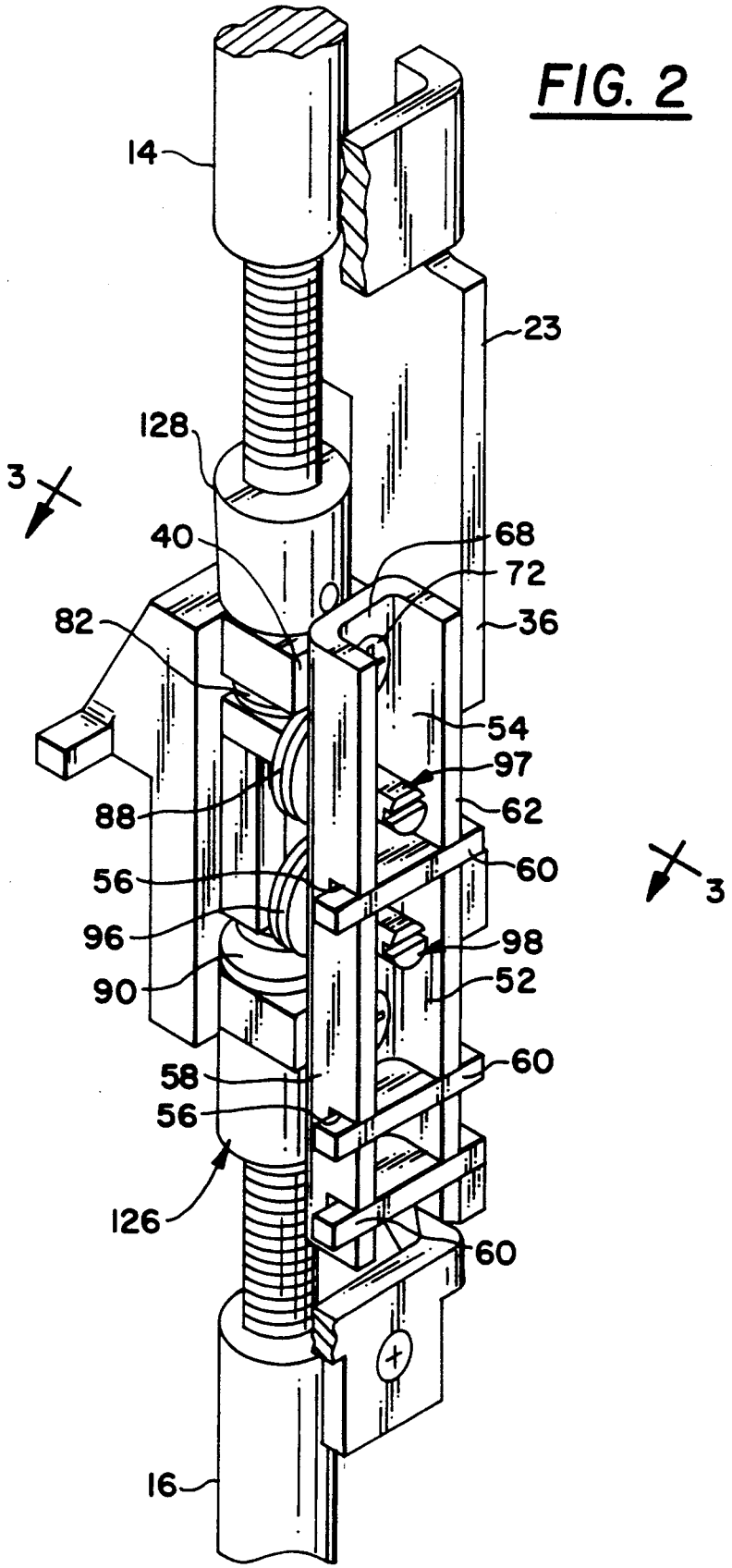
FIG. 2 is a perspective view of the motion transmitting member of the exit device of the present invention with the cover member shown partially removed.
Figure 3:
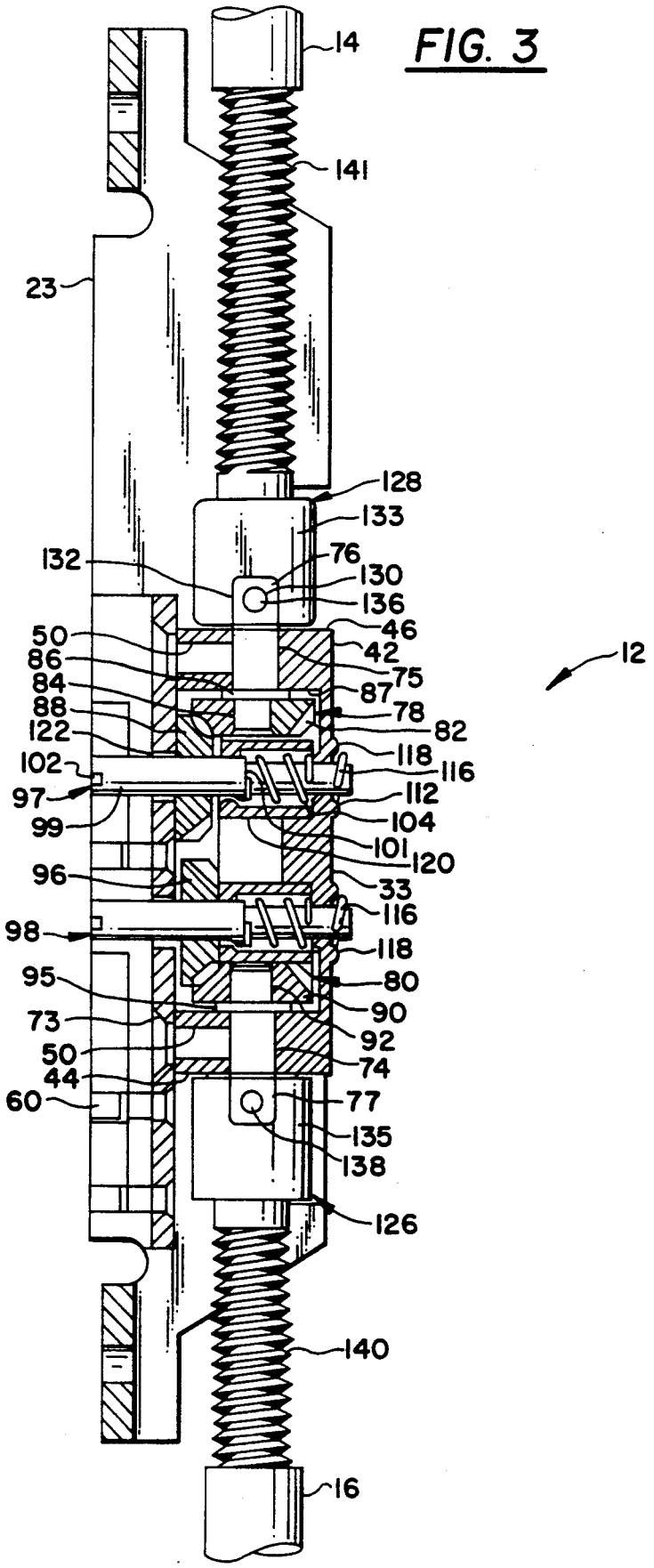
FIG. 3 is an enlarged partial sectional view taken along the line 3—3 of FIG. 2.

The motion transmitting member of the exit device 10 is shown in FIGS. 1-3, in accordance with the principles of the present invention. The motion transmitting member, generally indicated at 12, includes an adjustment mechanism, generally indicated at 25 having body 38. The body 38 includes an upper surface 40, a bottom surface 42, and side surfaces 44, 46. Threaded blind holes 50 are provided at each end of body 38. Body 38 further includes a cover member 52 disposed in channel 34 of the central portion 28. The cover member 52 is of U-shaped configuration defining an upwardly facing opening 54. A plurality of slots 56 are defined in sides 58 of the cover member 52. Disposed in the slots 56 are lift tabs 60. Lift tabs 60 extend across the opening 54 and beyond sides 58. When the cover member 52 is placed within the housing structure 23, the lift tabs 60 rest on ledges 37, 39, allowing top surface 62 of the cover member 52 to be aligned with surface 36 of the housing structure. One lift tab 60 is used to provide a contact point with the actuating bar mechanism 22, which is mounted on the outside of the door. The actuating bar mechanism is manually actuated to open a door secured by the exit device, which in turn moves the lift tab 60. As evident from FIG. 2, any one of the three lift tabs 60 may be selected and utilized so as to cooperate with various types of actuating bar mechanisms such as push-pad and cross-bar designs, which reduces the time to install the exit device. The operation of the lift tabs and actuating bar mechanism will become more apparent below.

Body 38 includes a protrusion 64 which cooperates with a manually actuated member (not shown) that is disposed on the outside surface of the door opposite the actuating bar mechanism, so that the door can be open from either side thereof.

Surface 68 of cover member 52 is provided with two tapered bores 73 utilized when affixing the body 38 thereto. Machine screws 72 are inserted into bores 73 to affix the cover member 52 to body 38 by engaging the threaded holes 50. Body 38 also includes bores 74, 75 extend respectively from sides 44, 46 into body 38. Shafts 77, 76 are movably disposed in bores 74, 75, the function of which will become more apparent below.

The adjustment mechanism 25 of the motion transmitting member 12 includes coupling assemblies, generally indicated a&: 78 and 80. The coupling assemblies can be configured using various motion transmission devices, but, referring to FIG. 3, there is shown therein the configuration of the coupling assemblies in accordance with the principles of the present invention.

The coupling assemblies transmit motion to the connecting rods 14, 16 of the motion transmitting member 12. One coupling assembly 78 is provided for movement of connecting rod 14, and one coupling assembly 80 is provided for movement of connecting rod 16. The coupling assemblies 78, 80 are disposed in the body 38 and retained therein by cover member 52, and lift tabs 60 and 64. Coupling assembly 78 includes a secondary bevel gear 82 having a bore 84 therein. Shaft 76 includes a flat which is fitted with bore 84 so as engage upon rotation thereof. Shaft 76 includes a large diameter portion 86, which abuts an inner surface 87 of body 38. Coupling assembly 78, further includes a primary bevel gear 88 disposed perpendicular to the secondary bevel gear 82, and being in an engaging relation therewith.

Coupling assembly 80 includes a secondary bevel gear 90 having a bore 92 therein. Shaft 77 includes a flat which is fitted with bore 92. Shaft 77 includes a large diameter portion 95, which abuts an inner surface 87 of body 38. Coupling assembly 80 further includes a primary bevel gear 96 disposed perpendicular to the secondary bevel gear 90, and being in engaging relation therewith.

The adjustment mechanism 25 includes actuating elements, generally indicated at 97 and 98, provided for each coupling assembly 78 and 80. The actuating elements are identically configured, therefore, only actuating element 97 will be described, noting that element 98 is similarly configured. Each actuating element 97,98 includes a primary pin 99. The pin 99 has a flat so as to engage a bore in the primary bevel gear 88 which has a mating flat portion. The pin 99 reduces in diameter so as to form a shoulder 101. A slot 102 is defined in each pin 99 which functions as a receiving member for accepting the head of a screw-driver or the like. Each actuating element 97,98 includes a spring 104 which is disposed about the periphery of a lower portion of the primary pin 99. The spring 104 is seated at one end on shoulder 101, and at the remaining end on an interior surface of body 38.

The primary pin 99 extends through bore 112 of body 38. The end of pin 99 includes a bore therethrough. A retainer 116 is fitted with the bore and extends beyond the diameter of pin 99 so as to engage the bottom surface 42 of body 38, to stably maintain the primary pin 99. The spring 104 functions to spring load the primary pin 99 so as to maintain constant pressure on the retainer 116 which is forced against body 38. The retainer 116 is of such length so as to prevent unwanted rotation of the primary pin 99, due to contact resistance with convex bumps 118 disposed about the periphery of bore 112. In the illustrative embodiment, four bumps are evenly spaced about the periphery of bore 112.

Actuating element 97 further includes a spacer 120 disposed about a lower portion of the primary pin 99 and spring 104, beneath the primary gear 88. The spacer 120 assures proper engagement of gears 82 and 88 in operation.

The actuating element 97 extends through bores 122 in cover member 52 and into opening 54. The actuating bar mechanism 22 is provided with a cover structure 127 fastened thereto by four screws 129 in the sides thereof. Removal of the screws and cover structure provides access to an access hole 124 through the actuating assembly of the bar mechanism 22. A screw-driver or the like may be inserted into the access hole so to engage the actuating elements 97,98. Since the actuating bar mechanism 22 is mounted on an outside surface of a door, the actuating elements are easily accessed through the access hole 124, once the cover structure is moved. Of course, the cover structure may be disposed in any location that is independent of the operation of the actuating bar mechanism, motion transmitting member and latching mechanisms, and need not be a part of the bar mechanism 22.

The adjustment mechanism 25 of the exit device 10 further includes connecting members, generally indicated at 126 and 128. Referring now to FIGS. 2 and 3, the preferred configuration of the connecting members is shown. Connecting member 128 is disposed at the end of body 38, affixed to shaft 76. Shaft 76 has a bore 130 therethrough. The connecting member 128 has a blind hole 132 in head 133, sized larger than the diameter of shaft 76. A hole 134 is bored perpendicularly from hole 132 in head 133. Shaft 76 is inserted into hole 132 of the connecting member and secured thereto with fixing pin 136 inserted through bore 130. The pin connection allows the connecting member 128 to rotate when the shaft 76 rotates. Connecting member 126 is similarly affixed to shaft 77, using pin 138. The connecting members 126, 128 are vertically aligned once affixed to shafts 76, 77.

Figure 6:
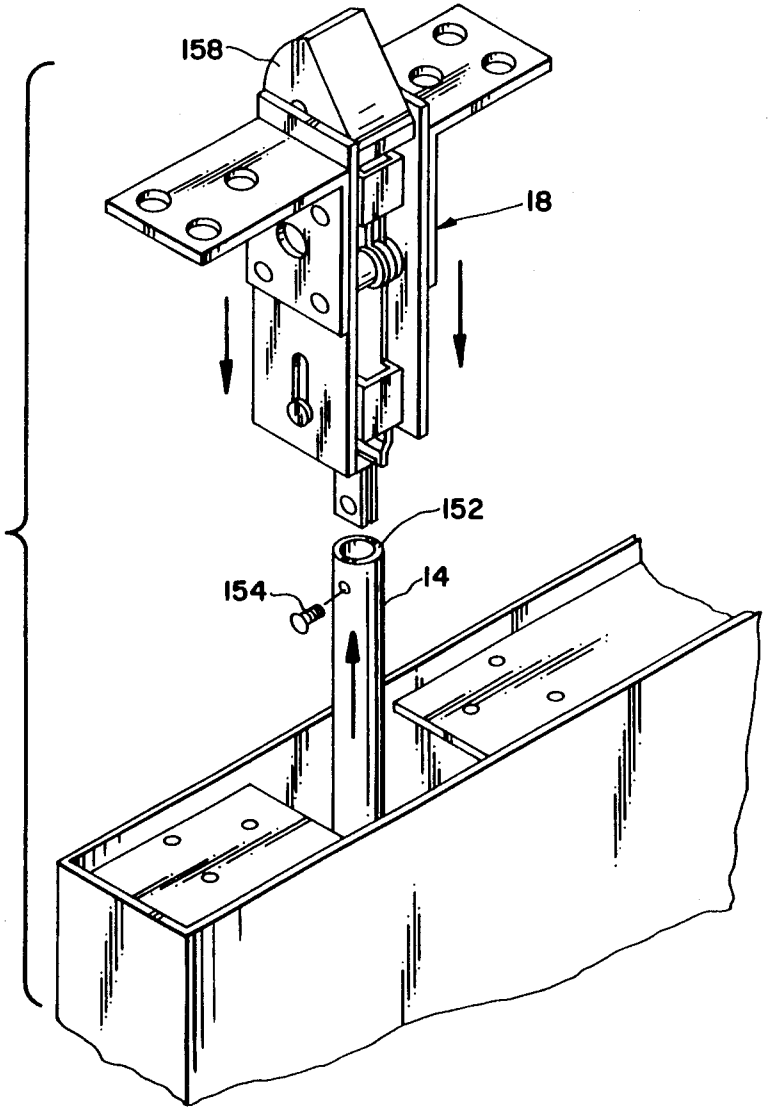
FIG. 6 is a perspective view of the cam latching mechanism of the exit device of the present invention shown protruding from the top of a door.
Figure 5:
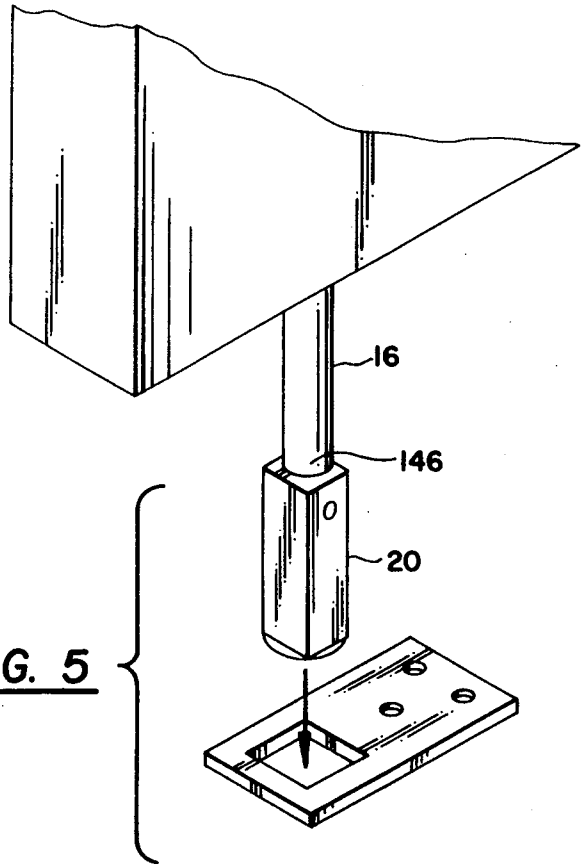
FIG. 5 is a perspective view of the dead bolt latching mechanism of the exit device of the present invention shown protruding from a door bottom.

The motion transmitting member 12 of the exit device 10 includes elongated connecting rods 14, 16 as shown in FIG. 1. Disposed from heads 133, 135 along the remaining length of connecting members 126, 128 are external threads 140, 141. Connecting rod 14 is fastened to connecting member 128 with threads 141, while connecting rod 16 is fastened to connecting member 126 with threads 140. The connecting rods 4, 16 have internal threads for mating the threads of the connecting members. In the illustrated embodiment, the connecting rods are elongated members, however, it can be appreciated that the connecting members can be elongated, while the connecting rods can be of reduced length. Disposed on end 146 of connecting rod 16 is a conventional dead bolt latching mechanism 20, while a conventional cam latching mechanism 18 is disposed on end 152 of connecting rod 14 using pin 154, as shown in FIGS. 5 and 6. The dead bolt latching mechanism 20 and cam latching mechanism 18 engage with mating catch and latch plate elements disposed in opposite ends of a door frame, when the door is closed.

The exit device 10 also includes an actuating bar mechanism, generally indicated at 22. The actuating bar mechanism 22 may be configured in many typical configurations such as cross-bar and push-pad designs. The preferred configuration of the actuating bar mechanism is shown in FIG. 1. The actuating bar mechanism 22 is operatively associated with a lift tab 60 utilizing conventional actuating techniques, so that a manual force exerted on bar 156 is converted to a vertically upward force on the lift tab 60. The operation of the actuating bar mechanism will become more apparent below.

Figure 7:
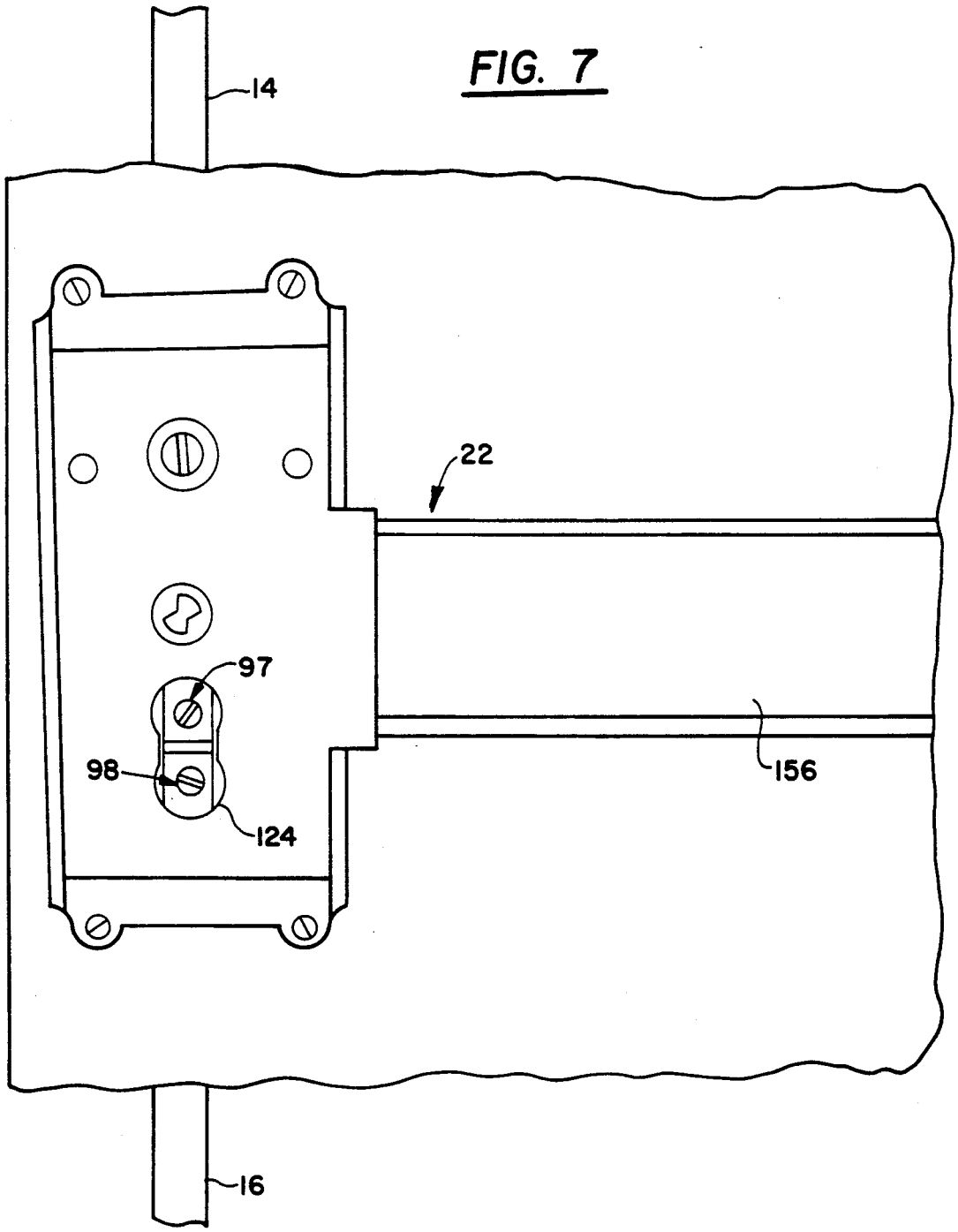
FIG. 7 is a partial front view of the exit device in operating condition on a door, shown with the cover plate of the actuating bar mechanism removed so to gain access for adjusting the device.

With reference to FIGS. 1, 4 and 7 the operation of the adjustment mechanism 25 of the device 10 for adjusting the length of the connecting rods 14, 16 will be appreciated.

The housing structure 23 is mounted to the inside surface of the door so that the motion transmitting member 12 is disposed vertically within the door. The actuating bar mechanism 22 is cooperable with the motion transmitting member by a lift tab 60. Upon removing cover structure 127, a screw driver is inserted horizontally through access hole 124 in slot 101 of actuating element 97. Of course, the actuating elements 97,98 may be so configured so that a hand tool such as a screwdriver is not required to rotate the actuating elements. For example, a knob may be provided with the actuating element to be rotated by hand. Since the actuating element is spring-loaded, the horizontal force exerted by the hand tool will allow the retainer 116 to pass beyond the bumps 118 on the bottom of the body 38 moving the actuating element from a set to an unset position. The actuating element 97 is then rotated which in turn causes primary bevel gear 88 to rotate. Since gear 88 is engaged with gear 82, the "horizontal" rotation of gear 88 is transmitted to a "vertical" rotation in gear 82. Shaft 76 will rotate, since it is affixed to gear 82. Rotation of shaft 76 in turn rotates connecting member 128, since it is securely fastened to the shaft 76. Depending upon the direction of rotation of the actuating element, the connecting member 128 will thread either in or out of the connecting rod 14, thereby permitting adjustment, either by increasing or decreasing the combined vertical length of the connecting member 128 and connecting rod 14 so as to adjust the fit of the cam latching mechanism 18 in relation to a mating element in a door frame. A clockwise rotation of the actuating element 97 disengages the threads of the connecting member 128 from connecting rod 14 increasing the combined vertical length of the connecting member 128 and rod 14. Counter-clockwise rotation of actuating element 97 further engages the connecting member 128 with the connecting rod 14 to reduce the combined vertical length of the connecting member and rod. The operation is similar for adjusting connecting rod 16 by turning actuating element 98. Thus, for example, a counter-clockwise rotation of actuating element 98 in turn disengages the threads of connecting member 126 from rod 16 so as to increase the combined length of the connecting member and rod which facilitates the adjustment of the dead bolt latching mechanism 20 so to properly mate with a catch plate in a door frame. Since the actuating bar mechanism 22 is in operable condition when the adjustment of the connecting rods is performed, the fit of the latching mechanisms with the mating elements in the door and the fit of the motion transmitting member with the actuating bar mechanism can be assured. Any further adjustment can be performed without disassembly of any operable portion of the device. Once the hand tool is used to make the adjustment and then removed, the spring-loaded adjustment element will force the retainer 116 against the body between the bumps 118 so that the adjustment is stably maintained. It therefore can be appreciated that the single actuating element provides for compound movement due to actuation of the hand tool, including an adjustment movement and a setting/unsetting movement.

It can be seen that the adjustment mechanism of the present invention can be used with conventional manual actuating devices which must be removed from the door to facilitate the adjustment, however, adjustment time will be increased, since all operable components of the device are not in cooperating relation.

The amount of adjustment obtainable in conventional devices is limited by physical constraints of the device. However, in the adjustment mechanism 25 of the present invention, the amount of adjustment is limited only by the length of the threaded connecting members, resulting in greater adjustment capability.

Once the adjustments are made to assure proper fit of the dead bolt and cam latching mechanisms with the door frame, the exit device 10 is in operating condition. With reference to FIGS. 4-6, the operation of the exit device of the present invention will be appreciated.

The actuating bar mechanism 22 is connected to a lift tab 60 so that manual force exerted on bar 156 causes the lift tab to move in an upwardly vertical direction. Since the lift tab 60 is affixed to the cover member 52, which in turn is affixed to body 38 of the motion transmitting member 12, the vertical movement of the lift tab 60 is transferred to the body 38. The motion transmitting member 12 slides upward in the housing structure 23, thus moving the connecting rods upward. This vertical motion releases the dead bolt latching mechanism 20 from a secured position. In addition the same vertical motion of the motion transmitting member 12 pivots latch 158 of the cam latching mechanism downward, which releases latch 158 from the door frame. Consequently, a door employing the exit device of the present invention is permitted to open. The total travel distance of the motion transmitting member 12 is controlled by stop 160 engaging with lift tab 60. This travel distance may be further controlled by selectively using one of the three lift tabs 60. The cam latching mechanism is of conventional design which reverses the upward vertical motion upon contact with latch 158, to secure a door upon the closing thereof.

It can be appreciated that the adjustment mechanism 25 of the motion transmitting member 12 can be utilized with other motion transmitting mechanisms which, instead of converting a manually actuated motion into a one directional vertical motion as in the present invention, converts the manually actuated motion into dual directional motion for releasing the latching mechanisms from their secured position.

It can be seen that the exit device with the adjustment mechanism provides a simple and effective means of adjusting the length of the connecting rods and thus, the fit of the dead bolt and cam latching mechanisms with plate elements in a door frame which reduces installation time, since there is no need to remove a substantial portion of the exit device to facilitate the adjustment. The use of the spring-loaded self locking primary pin to drive the bevel gears eliminates the need for set screws to secure the connecting rod after making the adjustment. In addition, because there is no load on the primary pin during use, there is minimal chance of failure of the device. Furthermore, a solid connection is formed between the two rods, which eliminates the use of bracketing to connect the rods to the adjustment mechanism thus, increases the strength of the exit device.

It thus will be appreciated that the objects of this invention have been fully and effectively accomplished. It will be realized, however, that the foregoing preferred embodiment of the present invention has been shown and described for the purposes of illustrating the structural and functional principles of the present invention and is subject to change without departure from such principles. Therefore, this invention includes all modifications encompassed within the spirit of the following claims.

What is claimed is:

1. A concealed exit device for mounting vertically within a door to cooperate with a threshold latch plate and an overhead latch plate in a door opening for latching and unlatching the door within the door opening, said concealed exit device comprising:

manually actuated means for mounting in a central portion of the door for manual movement from one side of the door between a normally biased position and an actuated position, upper and lower latching means for mounting in upper and lower ends of the door for movement between (1) extended latched positions in cooperating latched relation with the overhead and threshold latch plates respectively and (2) retracted unlatched positions out of cooperating relation with the latch plates, and motion-transmitting means between said centrally located manual actuated means and said end located upper and lower latching means for effecting movement of said upper and lower latching means from the extended latched positions thereof into the retracted unlatched positions thereof in response to the manual movement of said manual actuated means from the normally biased position thereof into the actuated position thereof, said motion-transmitting means including (1) an upper elongated motion-transmitting member extending vertically between said upper latching means and said manually actuated means (2) a lower elongated motion-transmitting member extending vertically between said lower latching means and said centrally located manually actuated means, (3) means for adjusting the operative vertical extent of said upper elongated motion-transmitting member and (4) means for adjusting the operative vertical extent of said lower elongated motion-transmitting member, to accommodate the vertical extend of the door, each of said adjusting means having movable means operatively connected with said upper and lower elongated motion-transmitting members for effecting movement between a set position where the adjustment of the operative vertical extent of said upper and lower elongated motion-transmitting members is prevented, and an unset position where the adjustment of the operative vertical extent of said upper and lower elongated motion-transmitting members is permitted to accommodate a particular vertical extend of the door within a predetermined range while said manually actuated means, said upper and lower latching means and said motion-transmitting means are in an operative relationship, said movably means including means cooperable to receive a generally horizontal input engaging manual motion and being operable when said input engaging manual motion has been received to move from a set to an unset position in response to an unsetting manual movement and thereafter moved to effect an adjustment of a motion transmitting member in response to an adjusting manual movement different from said unsetting movement, and exterior cover means independent of the operation of said manually actuated means, said motion-transmitting means and said upper and lower latching means operable to be moved from a normal covering position into a position providing exterior generally horizontal access to said movement means.

2. An exit device as claimed in claim 1, wherein said upper and lower elongated motion-transmitting members move in a common vertical direction in response to the manual movement of said manual actuating means.

3. An exit device as claimed in claim 2, wherein said upper latching means is a cam latching mechanism and said lower latching means is a deadbolt latching mechanism, said cam latching mechanism including means for reversing the movement of said upper motion-transmitting member.

4. An exit device as claimed in claim 1 wherein said motion transmitting means is mounted in a housing structure including means for engaging an interior surface of the door for fixedly mounting the housing structure within the door, said motion transmitting means being mounted for movement with respect to said housing structure.

5. An exit device as claimed in claim 4, wherein said motion-transmitting means includes a body mounted within said housing structure for movement, said movable means being carried by said body for vertical motion-transmitting movement therewith and for adjusting movement with respect thereto.

6. A concealed exit device for mounting vertically with in a door to cooperate with a threshold latch plate and an overhead latch plate in a door opening for latching and unlatching the door within the door opening, said concealed exit device comprising:

manually actuated means for mounting in a central portion of the door for manual movement from one side of the door between a normally biased position and an actuated position, upper and lower latching means for mounting in upper and lower ends of the door for movement between (1) extended latched positions in cooperating latched relation with the overhead and threshold latch plates respectively and (2) retracted unlatched positions out of cooperating relation with the latch plates, and motion-transmitting means between said centrally located manual actuated means and said end located upper and lower latching means for effecting movement of said upper and lower latching means from the extended latched positions thereof into the retracted unlatched positions thereof in response to the manual movement of said manual actuated means from the normally biased position thereof into the actuated position thereof, said motion-transmitting means including (1) an upper elongated motion-transmitting member extending vertically between said upper latching means and said manually actuated means (2) a lower elongated motion-transmitting member extending vertically between said lower latching means and said centrally located manually actuated means, (3) means for adjusting the operative vertical extend of said upper elongated motion-transmitting member and (4) means for adjusting the operative vertical extent of said lower elongated motion-transmitting member, to accommodate the vertical extend of the door, each of said adjusting means having movable means operatively connected with said upper and lower elongated motion-transmitting members for effecting the adjustment of the operative vertical extent of said upper and lower elongated motion-transmitting members to accommodate a particular vertical extent of the door within a predetermined range while said manually actuated means, said upper and lower latching means and said motion-transmitting means are in an operative relationship, said movable means including means cooperable to receive a generally horizontal input engaging manual motion and being operable when said input engaging manual motion has been received to move so as to effect an adjustment of a motion transmitting member in response to an adjusting manual movement, and exterior cover means independent of the operation of said manually actuated means, said motion-transmitting means and said upper and lower latching means operable to be moved from a normal covering position into a position providing exterior generally horizontal access to said movement means, wherein said upper and lower elongated motion-transmitting members are rod elements having first and second ends, said first ends being connected respectively with said latching means for vertical movement therewith and against rotational movement, said second ends of said rod elements being threadedly connected to said movable means.

7. An exit device as claimed in claim 1, wherein said receiving means comprises first and second pin members, each of said pin members including means for accepting a hand tool, whereby a generally horizontal engagement of one of said pin members with the hand tool permits (1) linear movement of the engaged pin member in a direction of a longitudinal axis thereof for effecting movement of the engaged pin member from a set position to an unset position and (2) rotational movement of the engaged pin member about the longitudinal axis thereof for effecting the adjustment of an associated motion-transmitting member.

8. A concealed exit device for mounting vertically within a door to cooperate with a threshold latch plate and an overhead latch plate in a door opening for latching and unlatching the door within the door opening, said concealed exit device comprising:

manually actuated means for mounting in a central portion of the door for manual movement from one side of the door between a normally biased position and an actuated position, upper and lower latching means for amounting in upper and lower ends of the door for movement between (1) extended latched positions in cooperating latched relation with the overhead and threshold latch plates respectively and (2) retracted unlatched positions out of cooperating relation with the latch plates, and motion-transmitting means between said centrally located manual actuated means and said end located upper and lower latching means for effecting movement of said upper and lower latching means from the extended latched positions thereof into the retracted unlatched positions thereof in response to the manual movement of said manual actuated means from the normally biased position thereof into the actuated position thereof, said motion-transmitting means including (1) an upper elongated motion-transmitting member extending vertically between said upper latching means and said manually actuated means (2) a lower elongated motion-transmitting member extending vertically between said lower latching means and said centrally located manually actuated means, (3) means for adjusting the operative vertical extent of said upper elongated motion-transmitting member and (4) means for adjusting the operative vertical extent of said lower elongated motion-transmitting member, to accommodate the vertical extend of the door, each of said adjusting means having movable means operatively connected with said upper and lower elongated motion-transmitting members for effecting the adjustment of the operative vertical extent of said upper and lower elongated motion-transmitting members to accommodate a particular vertical extent of the door within a predetermined range while said manually actuated means, said upper and lower latching means and said motion-transmitting means are in an operative relationship, said movable means including means cooperable to receive a generally horizontal input engaging manual motion and being operable when said input engaging manual motion has been received to move so as to effect an adjustment of a motion transmitting member in response to an adjusting manual movement, and exterior cover means independent of the operation of said manually actuated means, said motion-transmitting means and said upper and lower latching means operable to be moved from a normal covering position into a position providing exterior generally horizontal access to said movement means, wherein each of said movable means includes a pair of first and second bevel gears and a threaded connecting member, each of said first bevel gears being operatively associated with one of said receiving means, each of said second bevel gears being rotatable about an axis perpendicular to an axis of rotation of said first bevel gear, each of said first bevel gears being meshingly engaged with an associated second bevel gear, each of said second bevel gears being coupled to an associated threaded connecting member for movement therewith, each of said connecting members being threadedly engaged with one of said upper and lower motion-transmitting members, whereby the movement of each of said receiving means in response to the manually adjusting movement rotates an associated connecting member to effect vertical adjustment of an associated motion-transmitting member.

9. An exit device as claimed in claim 8, wherein (1) a first movement of each of said receiving means threadedly disengages an associated connecting member from an associated motion-transmitting member so as to increase the combined vertical length of said connecting member and said motion-transmitting member, and (2) movement of each of said receiving means in a direction opposite said first movement further threadedly engages an associated connecting member with an associated motion-transmitting member so as to reduce the combined vertical length of said connecting member and said motion-transmitting member.

10. An exit device as claimed in claim 8, wherein each of said receiving means is a pin member having first and second ends, said first end including means for rotating said pin member, said second end including means for stably maintaining said pin member in a predetermined position, said pin member being fitted with an associated first bevel gear.

11. An exit device as claimed in claim 10, wherein said means for rotating said pin member is a slot being cooperable with a hand tool for effecting rotation of said pin member.

12. An exit device as claimed in claim 10, wherein each of said pin members are disposed in a body, each of said pin members having an end disposed through a bore in said body so that said end extends beyond a surface of said body, said means for stably maintaining said pin member including a bore through said pin member and a locking pin being disposed in said bore to contact said surface of said body.

13. An exit device as claimed in claim 12, wherein said surface of said body includes a plurality of convex protrusions disposed about the periphery of said bore, said locking pin contacting said protrusions so as to prevent unwanted rotation of said pin member.

14. An exit device as claimed in claim 12, wherein each of said pin members further includes a flat surface being fitted with bore of an associated first bevel gear so to effect rotation thereof, each of said pin members having an upper and lower portion, each of said pin members provided with a spring disposed about said lower portion, each of said springs maintaining a constant pressure on an associated locking pin forcing said locking pin against said body so as to maintain said pin member in a set position, whereby movement of said pin member with a hand tool moves said locking pin from said set position.

15. An exit device as claimed in claim 5, wherein said body includes a cover member affixed to said upper surface thereof, said cover member having an channel-like opening therein permitting a portion of said movable means to pass therethrough, said cover member retaining said movable means in said body.

16. A concealed exit device for mounting vertically within a door to cooperate with a threshold latch plate and an overhead latch plate in a door opening for latching and unlatching the door within the door opening, said concealed exit device comprising:

manually actuated means for mounting in a central portion of the door for manual movement form one side of the door between a normally biased position and an actuated position, upper and lower latching means for mounting in upper and lower ends of the door for movement between (1) extended latched positions in cooperating latched relation with the overhead and threshold latch plates respectively and (2) retracted unlatched positions out of cooperating relation with the latch plates, and motion-transmitting means between said centrally located manual actuated means and said end located upper and lower latching means for effecting movement of said upper and lower latching means from the extended latched positions thereof into the retracted unlatched positions thereof in response to the manual movement of said manual actuated means from the normally biased position thereof into the actuated position thereof, said motion-transmitting means including (1) and upper elongated motion-transmitting member extending vertically between said upper latching means and said manually actuated means (2) a lower elongated motion-transmitting member extending vertically between said lower latching means and said centrally located manually actuated means, (3) means for adjusting the operative vertical extent of said upper elongated motion-transmitting member and (4) means for adjusting the operative vertical extend of said lower elongated motion-transmitting member to accommodate the vertical extent of the door, each of said adjusting means having movable means operatively connected with said upper and lower elongated motion-transmitting members for effecting the adjustment of the operative vertical extent of said upper and lower motion-transmitting members to accommodate a particular vertical extent of the door within a predetermined range while said manually actuated means, said upper and lower latching means and said motion-transmitting means are in an operative relationship, said movable means including means cooperable to receive a generally horizontal input engaging manual motion being operable when said input engaging manual motion has been received to move so as to effect an adjustment of a motion transmitting member in response to an adjusting manual movement, and exterior cover means independent of the operation of said manually actuated means, said motion-transmitting means and said upper and lower latching means operable to be moved from a normal covering position into a position providing exterior generally horizontal access to said movement means, wherein said motion transmitting means is mounted in a housing structure including means for engaging an interior surface of the door for fixedly mounting the housing structure within the door, and wherein said motion-transmitting means includes a body mounted within said housing structure for movement, said movable means being carried by said body for vertical motion-transmitting movement therewith and for adjusting movement with respect thereto, and wherein said body includes a cover member affixed to said upper surface thereof, said cover member having an channel-like opening therein permitting a portion of said movable means to pass therethrough, said cover member retaining said movable means in said body, said cover member including a plurality of slots disposed perpendicular to said channel-like opening, at least one tab element being selectively disposed in at least one of said slots, said at least one tab element being engaged with said manually actuated means for effecting vertical movement of said body.

17. An exit device as claimed in claim 1, wherein said exterior cover means i cooperable with said manually actuated means.

18. An exit device as claimed in claim 1, wherein said movable means are first and second pin member adjacently positioned, said pin members disposed within the interior portion of the door so as to be accessible from an exterior portion of the door once said cover means is moved from a normal covering position to a position providing generally horizontal access to said pin members.

19. A concealed exit device for mounting vertically within a door to cooperate with a threshold latch plate and an overhead latch plate in a door opening for latching and unlatching the door within the door opening in response to a manually actuated movement of an actuating member mounted centrally on an exterior portion of a door, said concealed exit device comprising:

upper and lower latching means for mounting in upper and lower ends of the door for movement between (1) extended latched positions in cooperating latched relation with the overhead and threshold latch plates respectively and (2) retracted unlatched positions out of cooperating relation with the latch plates, and motion-transmitting means between said end located upper and lower latching means, said motion-transmitting means including (1) an upper elongated motion-transmitting member extending from central portion of said motion-transmitting means to said upper latching means (2) a lower elongated motion-transmitting member disposed between said upper elongated motion transmitting member and said lower latching means, (3) means for adjusting the operative vertical extend of said upper motion-transmitting member and (4) means for adjusting the operative vertical extend of said lower motion-transmitting member, to accommodate the vertical extend of the door, each of said adjusting means having movable means operatively connected with said upper and lower elongated motion-transmitting members for effecting movement between a set position wherein the adjustment of the operative vertical extend of said upper and lower motion-transmitting members is prevented and an unset position where the adjustment of the operative vertical extend of said upper and lower motion-transmitting members to accommodate a particular vertical extend of the door within a predetermined range, said movable means including mans cooperable to receive a generally horizontal input engaging manual motion being operable when said input engaging manual motion has been received to move from a set to an unset position in response to an unsetting manual movement and thereafter moved to effect an adjustment of a motion transmitting member in response to an adjusting manual movement different from said unsetting manual movement.

20. An exit device as claimed in claim 1, wherein said upper and lower elongated motion-transmitting members are rod elements having first and second ends, said first ends being connected respectively with said latching means for vertical movement therewith and aginst rotational movement, said second ends of said rod elements being threadedly connected to said movable means.

21. An exit device as claimed in claim 1, wherein each of said movable means includes a pair of first and second bevel gears and a threaded connecting member, each of said first bevel gears being operatively associated with one of said receiving means, each of said second bevel gears being rotatable about an axis perpendicular to an axis of rotation of said first bevel gear, each of said first bevel gears being meshingly engaged with an associated second bevel gear, each of said second bevel gears being coupled to an associated threaded connecting member for movement therewith, each of said connecting members being threadedly engaged with one of said upper and lower motion-transmitting members, whereby the movement of each of said receiving means in response to the manually adjusting movement rotates an associated connecting member to effect vertical adjustment of an associated motion-transmitting member.

22. An exit door device as claim din claim 15, wherein said cover member includes a plurality of slots disposed perpendicular to said channel-like opening, at least one tab element being selectively disposed in at least one of said slots, said at least one tab element being engaged with said manually actuated means for effecting vertical movement of said body.

* * * * *

UNITED STATES PATENT AND TRADEMARK OFFICE

CERTIFICATE OF CORRECTION

PATENT NO. : 5,154,454

DATED : October 13, 1992

INVENTOR(S) : William G. Hollaway

It is certified that error appears in the above-identified patent and that said Letters Patent is hereby corrected as shown below:

Title page, correct Item [73] to read:

Assignee: Monarch Hardware & Mfg. Co., Inc.,
Shepherdsville, Ky.

Signed and Sealed this

Nineteenth Day of October, 1993

*Attest:*

*Attesting Officer*

BRUCE LEHMAN

*Commissioner of Patents and Trademarks*